US011255003B2

(12) United States Patent
Yang et al.

(10) Patent No.: US 11,255,003 B2
(45) Date of Patent: Feb. 22, 2022

(54) TA-CONTAINING FE-NI BASED SUPERALLOYS WITH HIGH STRENGTH AND OXIDATION RESISTANCE FOR HIGH-TEMPERATURE APPLICATIONS

(71) Applicant: UT-Battelle, LLC, Oak Ridge, TN (US)

(72) Inventors: Ying Yang, Farragut, TN (US); Bruce A. Pint, Knoxville, TN (US); Jonathan D. Poplawsky, Knoxville, TN (US); Lizhen Tan, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 22 days.

(21) Appl. No.: 16/834,767

(22) Filed: Mar. 30, 2020

(65) Prior Publication Data

US 2020/0354820 A1 Nov. 12, 2020

Related U.S. Application Data

(60) Provisional application No. 62/827,930, filed on Apr. 2, 2019.

(51) Int. Cl.

| | |
|---|---|
| ***C22C 30/00*** | (2006.01) |
| ***C22C 38/48*** | (2006.01) |
| ***C22C 38/08*** | (2006.01) |
| ***C22C 38/18*** | (2006.01) |

(52) U.S. Cl.

CPC ..... *C22C 30/00* (2013.01); *C22C 38/08* (2013.01); *C22C 38/18* (2013.01); *C22C 38/48* (2013.01)

(58) Field of Classification Search

None

See application file for complete search history.

(56) References Cited

U.S. PATENT DOCUMENTS

| | | | |
|---|---|---|---|
| 7,651,575 B2 | 1/2010 | Sawford et al. | |
| 8,506,884 B2 | 8/2013 | Haruyama et al. | |
| 8,512,488 B2 | 8/2013 | Imano et al. | |
| 8,815,146 B2 | 8/2014 | Yamamoto et al. | |
| 2013/0266477 A1* | 10/2013 | Yamamoto ..... | C22C 38/06 420/54 |

OTHER PUBLICATIONS

Pollock, T.M. and Tin, S., Nickel-based superalloys for advanced turbine engines: chemistry, microstructure and properties, Journal of propulsion and power, 22 (2006) 361-374.

Donachie, M.J. and Donachie, S.J., Superalloys: a technical guide. 2002: ASM international.

Thompson, A. and Brooks, J., The mechanism of precipitation strengthening in an iron-base superalloy, Acta Metallurgica, 30 (1982) 2197-2203.

(Continued)

*Primary Examiner* — Brian D Walck

(74) *Attorney, Agent, or Firm* — Fox Rothschild LLP

(57) ABSTRACT

A Fe—Ni based alloy comprising, in weight percent: Ni 30-35; Cr 12-14; Al 3-5; Ti 0-2; Ta 2-8; C<=0.05; B<=0.005; Zr<=0.2; Si<0.5; where Cr/(Cr+Fe+Ni)=0.125-0.145; Al/(Al+Ti+Ta)=0.15-0.5; and Fe≥Ni; balance Fe, the alloy having a face-centered cubic (fcc) matrix with from 25 to 30 vol. % of $L1_2$-type γ'-Ni3M (M=Al, Ta, Ti and mixtures thereof) precipitates.

7 Claims, 11 Drawing Sheets

(56) References Cited

OTHER PUBLICATIONS

Sabol, G. and Stickler, R., Microstructure of Nickel?Based Superalloys, physica status solidi (b), 35 (1969) 11-52.
De Cicco, H., Luppo, M., Gribaudo, L. and Ovejero-Garc?a, J., Microstructural development and creep behavior in A286 superalloy, Materials characterization, 52 (2004) 85-92.
Azadian, S., Wei, L.-Y. and Warren, R., Delta phase precipitation in Inconel 718, Materials characterization, 53 (2004) 7-16.
Kuo, C.-M., Yang, Y.-T., Bor, H.-Y., Wei, C.-N. and Tai, C.-C., Aging effects on the microstructure and creep behavior of Inconel 718 superalloy, Materials Science and Engineering: A, 510 (2009) 289-294.

* cited by examiner

TA-CONTAINING FE-NI BASED SUPERALLOYS WITH HIGH STRENGTH AND OXIDATION RESISTANCE FOR HIGH-TEMPERATURE APPLICATIONS

CROSS-REFERENCE TO RELATED APPLICATIONS

This application claims priority to U.S. Provisional Application No. 62/827,930 filed on Apr. 2, 2019, entitled "Ta-containing Fe—Ni based superalloys with high strength and oxidation resistance for high-temperature (700-950° C.) applications", the entire disclosure of which incorporated herein by reference.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in this invention.

FIELD OF THE INVENTION

The present invention relates to high temperature superalloys, and more particularly to Fe—Ni based superalloys.

BACKGROUND OF THE INVENTION

Ni-based superalloys are a family of strong and tough metallic materials extensively used in aircraft and power-generation turbines, rocket engines and other challenging environments. The exceptional combination of high-temperature strength and toughness in Ni-based superalloys is primarily due to the formation of a high volume-fraction of thermodynamically stable, chemically ordered $L1_2$-type (g') $Ni_3Al$ nano-precipitates, which are coherently interfaced with and homogeneously distributed in the Ni-based fcc (face centered cubic) matrix. However, achieving a similar microstructure in low-cost Fe—Ni-based materials remains a challenge. The existing Fe—Ni-based superalloys, such as A286, or Ni—Fe-based superalloys, such as Incoloy 901, Inconel 706, and Inconel 718, are primarily strengthened by metastable $L1_2$-type $Ni_3Ti$ (g') or $D0_{22}$-type $Ni_3Nb$ (g") phases. While these alloys greatly benefit from these metastable precipitates, the properties degrade when the stable counterpart precipitates form. For example, the metastable $L1_2$-type $Ni_3Ti$ (g') precipitates can transform to the $D0_{24}$-type $Ni_3Ti$(h) phase after long thermal exposure. Similarly, the orthorhombic $Ni_3Nb$ (d) phases can directly precipitate at grain boundaries or be transformed from the $D0_{22}$ precipitates. Both the h and d precipitates are incoherent with the fcc matrix and do not confer strength when present in large quantities.

For Fe-based or Fe—Ni based superalloys, U.S. Pat. No. 7,651,575 (Jan. 26, 2010) "Wear Resistant high temperature alloy", U.S. Pat. No. 8,512,488 (Aug. 20, 2013) "Ni—Fe based Forging superalloy excellent in high temperature strength and high-temperature ductility, method of manufacturing the same, and steam turbine rotor", U.S. Pat. No. 8,506,884 (Aug. 12, 2013) "g phase strengthened Fe—Ni base superalloy", and U.S. Pat. No. 8,815,146 (Aug. 26, 2014) "Alumina Forming iron base superalloy" are known.

There remains a need for lower cost alloys with high temperature strength and acceptable oxidation resistance.

SUMMARY OF THE INVENTION

A Fe—Ni based alloy comprising, in weight percent, Ni 30-35; Cr 12-14; Al 3-5; Ti 0-2; Ta 2-8; C<=0.05; B<=0.005; Zr<=0.2; Si<0.5; Cr/(Cr+Fe+Ni)=0.125-0.145; Al/(Al+Ti+Ta)=0.15-0.5; Fe ‡ Ni; Fe/Ni=1.0-2.0; balance Fe, the alloy having a face-centered cubic (fcc) matrix with from 25 to 30 vol. % of $L1_2$-type g'-$Ni_3M$ (M=Al, Ta, Ti and mixtures thereof) precipitates.

The $L1_2$-type g'-$Ni_3M$ precipitates have a mean radius of from 5 to 10 nm and number density in the order of $1\times10^{23}$ to $1\times10^{24}$ #/$m^3$. The $L1_2$-type g'-$Ni_3M$ precipitates can have a composition of (Ni+Fe+Cr) @ 75 at % and (Al+Ti+Ta) @ 25 at % and the matrix have a composition of (Fe+Cr+Ni) ‡95 at % and (Al+Ti+Ta) £ 5 at %. The alloy can be free of precipitates other than $L1_2$-type g'-$Ni_3M$ precipitates and can have a combined volume fraction of other precipitate phases that is less than 3%, determined from the detection limit of neutron scattering. The lattice mismatch of the $L1_2$-type g'-$Ni_3M$ precipitates and the fcc matrix can be less than 0.05%.

The Fe—Ni based alloy can have high temperature yield strength greater than or equal to 800 MPa at 700 C and greater than 500 MPa at 800 C. The Fe—Ni based alloy can have an oxidation rate constant at 800° C. in air+10% water vapor that is from $1\times10^{-13}$ to $1\times10^{-14}$ ($g^2/cm^4\cdot s$).

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

A Fe—Ni based alloy comprising, in weight percent; Ni 30-35, Cr 12-14, Al 3-5, Ti 0-2, Ta 2-8, C<=0.05, B<=0.005, Zr<=0.2, Si<0.5, Cr/(Cr+Fe+Ni)=0.125-0.145, Al/(Al+Ti+Ta)=0.15-0.5, Fe ‡ Ni, balance Fe, the alloy having a face-centered cubic (fcc) matrix with 25~30 vol. % of $L1_2$-type g'-$Ni_3M$ (M=Al, Ta, Ti and mixtures thereof) precipitates. The alloys of the invention are particularly suited as alternative materials of Ni-based superalloys but with lower Ni, and thus lower cost for high temperature (for example 700-900° C.) applications.

Figure 1:
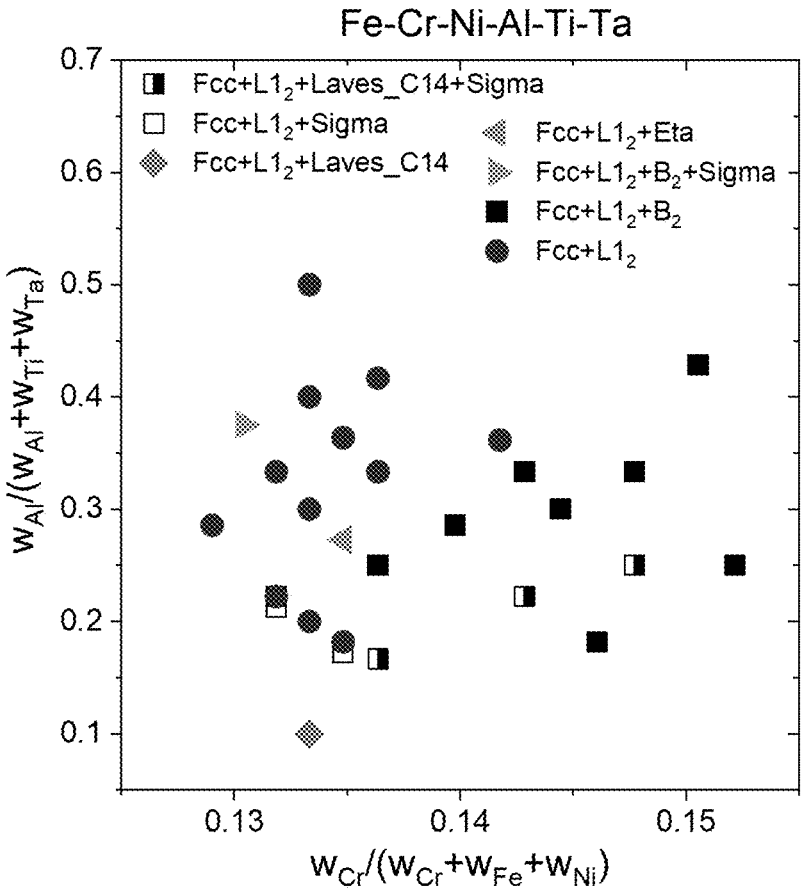
FIG. 1 is a composition ratio map showing the stable Fcc+$L1_2$ two-phase region.
Figure 2:
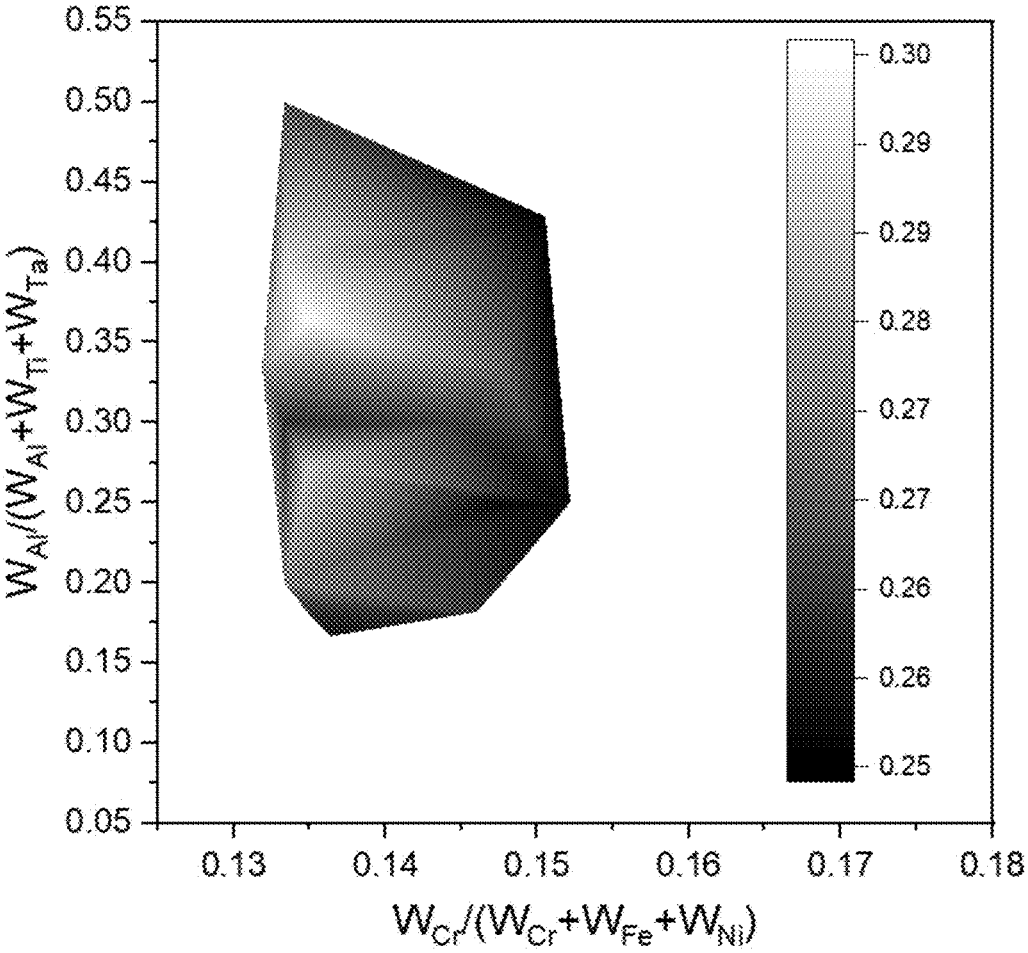
FIG. 2 is a composition ratio map showing the amount of $L1_2$ phase.

Screening the phase equilibrium in the Fe—Cr—Ni—Al—Ti—Ta was performed by using the high-throughput calculation (HTC) using Pandat software [Cao, Weisheng, S-L. Chen, Fan Zhang, K. Wu, Y. Yang, Y. A. Chang, R. Schmid-Fetzer, and W. A. Oates. "PANDAT software with PanEngine, PanOptimizer and PanPrecipitation for multi-component phase diagram calculation and materials property simulation." *Calphad* 33, no. 2 (2009): 328-342, incorporated herein by reference]. A total of 10500 compositions were screened and 30 compositions were determined to meet the design criteria, which is a volume fraction of $L1_2$ greater than 0.25 and a combined volume fraction of other precipitates less than 0.03. The phase equilibrium and the amount of $L1_2$ phase presented in these alloys are plotted against with the composition ratio of Cr/(Cr+Fe+Ni) and Al/(Al+Ti+Ta) in FIG. 1 and FIG. 2, respectively. The ratio Cr/(Cr+Fe+Ni) for the $L1_2$-only phase (indicated as "Fcc+$L1_2$") is shown as being from 0.125-0.145. The ratio Al/(Al+Ti+Ta) for this $L1_2$-only phase in this plot is from 0.15 to 0.5.

The amount of Ni can be from 30-35 wt. %. The Ni can be 30, 30.25, 30.5, 30.75, 31, 31.25, 31.5, 31.75, 32, 32.25, 32.5, 32.75, 33, 33.25, 33.5, 33.75, 34, 34.25, 34.5, 34.75, and 35 wt. %. The Ni can be within a range of any high value and low value selected from these values.

The amount of Cr can be from Cr 12-14 wt. %. The Cr can be 12, 12.25, 12.5, 12.75, 13, 13.25, 13.5, 13.75 and 14 wt. %. The Cr can be within a range of any high value and low value selected from these values.

The amount of Al can be from 3-5 wt. %. The Al can be 3, 3.25, 3.5, 3.75, 4, 4.25, 4.5, 4.75 and 5 wt. %. The Al can be within a range of any high value and low value selected from these values.

The amount of Ti can be from 0-2 wt. %. The Ti can be 0, 0.1, 0.25, 0.5, 0.75, 1, 1.25, 1.5, 1.75 and 2 wt. %. The Ti can be within a range of any high value and low value selected from these values.

The amount of Ta can be from 2-8 wt. %. The Ta can be 2, 2.1, 2.2, 2.3, 2.4, 2.5, 2.6, 2.7, 2.8, 2.9, 3, 3.1, 3.2, 3.3, 3.4, 3.5, 3.6, 3.7, 3.8, 3.9, 4, 4.1, 4.2, 4.3, 4.4, 4.5, 4.6, 4.7, 4.8, 4.9, 5, 5.1, 5.2, 5.3, 5.4, 5.5, 5.6, 5.7, 5.8, 5.9, 6, 6.1, 6.2, 6.3, 6.4, 6.5, 6.6, 6.7, 6.8, 6.9, 7, 7.1, 7.2, 7.3, 7.4, 7.5, 7.6, 7.7, 7.8, 7.9, and 8 wt. %. The Ta can be within a range of any high value and low value selected from these values.

The amount of C can be less than or equal to 0.05 wt. %. The amount of C can be 0, 0.001, 0.0025, 0.005, 0.0075, 0.01, 0.02, 0.03, 0.04, and 0.05 wt. %. The C can be within a range of any high value and low value selected from these values.

The amount of B can be less than or equal to 0.005 wt. %. The amount of B can be 0, 0.0001, 0.00025, 0.0005, 0.00075, 0.001, 0.002, 0.003, 0.004, and 0.005 wt. %. The B can be within a range of any high value and low value selected from these values.

The amount of Zr can be less than or equal to 0.2 wt. %. The amount of Zr can be 0.01, 0.0125, 0.015, 0.0175, 0.02, 0.03, 0.04, 0.05, 0.06, 0.07, 0.08, 0.09, 0.1, 0.11, 0.12, 0.13, 0.14, 0.15, 0.16, 0.17, 0.18, 0.19 and 0.2 wt. %. The Zr can be within a range of any high value and low value selected from these values.

The amount of Si can be less than 0.5 wt. %. The amount of Si can be 0, 0.01, 0.02, 0.03, 0.04, 0.05, 0.06, 0.07, 0.08, 0.09, 0.1, 0.2, 0.3, 0.4, 0.425, 0.45, 0.475 and 0.499 wt. %. The Si can be within a range of any high value and low value selected from these values.

The ratio of Cr/(Cr+Fe+Ni) can be from 0.125-0.145. The ratio of Cr/(Cr+Fe+Ni) can be 0.125, 0.1275, 0.13, 0.1325, 0.135, 0.1375, 0.14, 0.1425, and 0.145. The ratio of Cr/(Cr+Fe+Ni) can be within a range of any high value and low value selected from these values.

The ratio of Al/(Al+Ti+Ta) can be from 0.15-0.5. The ratio of Al/(Al+Ti+Ta) can be 0.15, 0.175, 0.2, 0.225, 0.25, 0.275, 0.3, 0.325, 0.35, 0.375, 0.4, 0.425, 0.45, 0.475 and 0.5. The ratio of Al/(Al+Ti+Ta) can be within a range of any high value and low value selected from these values.

The amount of Fe can be from 40 to 50 wt. %. The amount of Fe can be 40, 41, 42, 43, 44, 45, 46, 47, 48, 49 or 50 wt. %. The amount of Fe can be within a range of any high value and low value selected from these values.

The amount of Fe in wt. % is greater than or equal to the amount of Ni. The ratio of Fe to Ni can be from 1 to 2. The ratio of Fe to Ni can be 1, 1.1, 1.2, 1.3, 1.4, 1.5, 1.6, 1.7, 1.8, 1.9, and 2. The ratio of Fe to Ni can be within a range of any high value and low value selected from these values.

The alloys of the invention having a face-centered cubic (fcc) matrix with 25~30 vol. % of $L1_2$-type g'-$Ni_3M$ (M=Al, Ta, Ti and mixtures thereof) precipitates. The vol. % of $L1_2$-type g'-$Ni_3M$ precipitates can be 25, 25.1, 25.2, 25.3, 25.4, 25.5, 25.6, 25.7, 25.8, 25.9, 26, 26.1, 26.2, 26.3, 26.4, 26.5, 26.6, 26.7, 26.8, 26.9, 27, 27.1, 27.2, 27.3, 27.4, 27.5, 27.6, 27.7, 27.8, 27.9, 28, 28.1, 28.2, 28.3, 28.4, 28.5, 28.6, 28.7, 28.8, 28.9, 29, 29.1, 29.2, 29.3, 29.4, 29.5, 29.6, 29.7, 29.8, 29.9 and 30 vol %. The vol. % of $L1_2$-type g'-$Ni_3M$ precipitates can be within a range of any high value and low value selected from these values.

The combined volume fraction of other precipitates can be less than 3 vol. %. The combined volume fraction of other precipitates can be 0, 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, and 3 vol. %. The combined volume fraction of other precipitates can be within a range of any high value and low value selected from these values.

Sample alloys according to the invention were prepared and tested with commercially available alloys. The compositions of these alloys are indicated in Table 1 below, where FCNATT-2A and FCNATT-3A are alloys with the same composition but annealed at different temperature made according to the invention:

TABLE 1

The compositions of the alloys of the invention and commercial alloys

| Alloy composition, wt % | C | Fe | Ni | Cr | Si | Mo | Co | W | Mn | Nb | Al | Ti | Ta |
|---|---|---|---|---|---|---|---|---|---|---|---|---|---|
| FCNATT-2A | <0.05 | 43.7 | 35 | 13 | 0 | 0 | 0 | 0 | 0 | 0 | 3 | 1.5 | 3.8 |
| FCNATT-3A | <0.05 | 43.7 | 35 | 13 | 0 | 0 | 0 | 0 | 0 | 0 | 3 | 1.5 | 3.8 |
| 718plus | 0.025 | 9.5-10 | 52.1 | 18 | 0 | 2.7 | 9.1 | 1 | 0 | 5.4 | 1.45 | 0.75 | 0 |
| H282 | 0.06 | <1.5 | 57 | 20 | 0 | 8.5 | 10 | 0 | 0 | 0 | 1.5 | 2.1 | 0 |
| AFA-OC4 | 0.1 | 44 | 25 | 14 | 0 | 2 | 0 | 1 | 2 | 2.5 | 3.5 | 0 | 0 |
| 347H | 0.04~1.0 | 62.83-73.64 | 9-13 | 17-20 | 1 | 0 | 0 | 0 | 2 | 0.32-1 | 0 | 0 | 0 |
| P92 | 0.1 | 87.49 | 0.13 | 9.5 | 0.29 | 0.36 | 0 | 1.74 | 0.42 | 0.062 | 0.009 | 0 | 0 |

Figure 3:
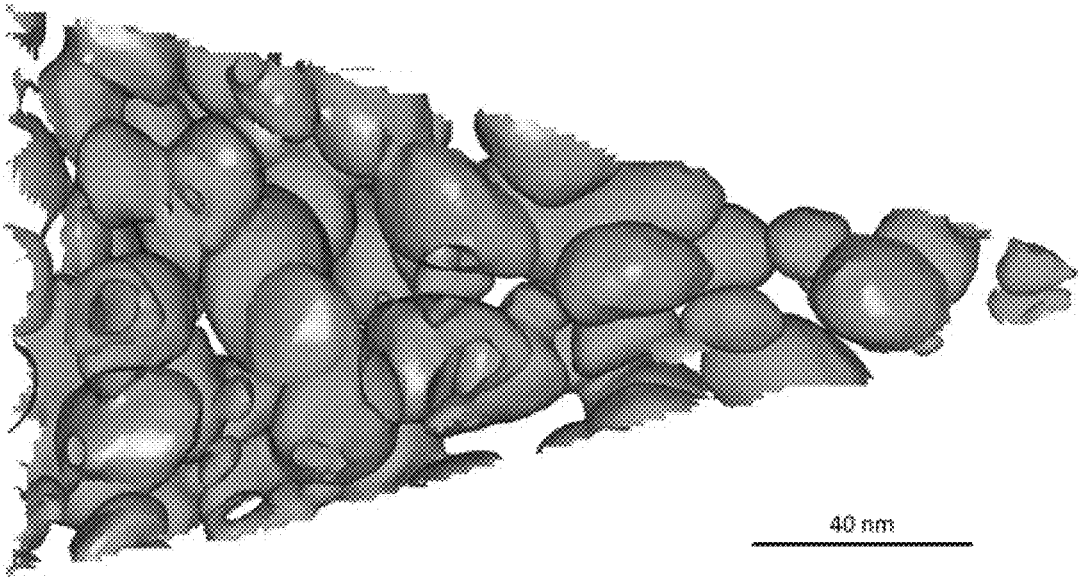
FIG. 3 is a representation of the $L1_2$ precipitates.

FIG. 3 is a representation of $L1_2$ precipitates. The distribution characteristics were characterized by atom probe tomography. A representation of the precipitates is shown in FIG. 3. The $L1_2$-type g'-Ni3M precipitates have a mean radius of from 5 to 10 nm and number density in the order of from $1\times10^{23}$ to $1\times10^{24}$ #/m$^3$.

Figure 4:
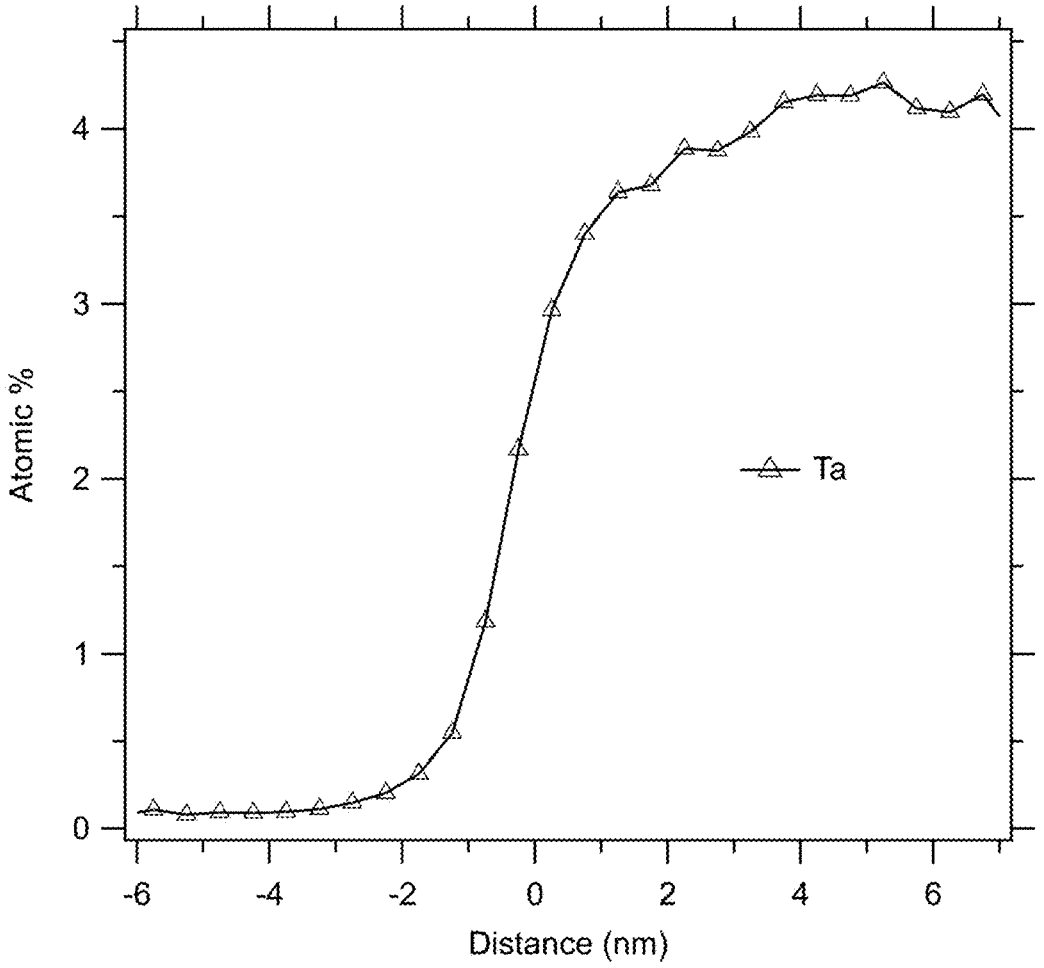
FIG. 4 is a plot of atomic % Ta vs. distance (nm) from the precipitate/matrix interface.
Figure 5:
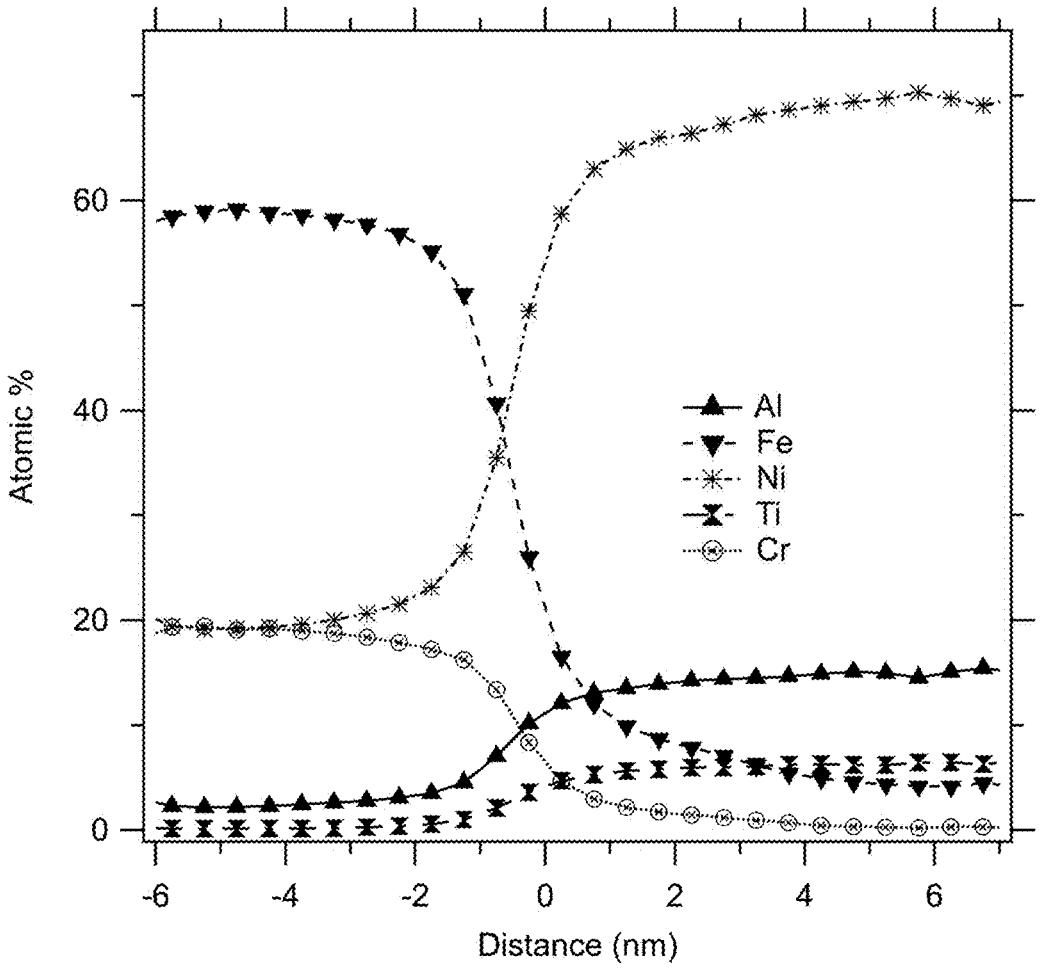
FIG. 5 is a plot of atomic % vs. distance (nm) from the precipitate/matrix interface for Al, Fe, Ni, Ti, and Cr.

Atom probe measurements for the precipitates in the FCNATT alloy annealed at 700° C. were performed. Precipitate and matrix compositions characterized by Atom probe tomography are shown in FIG. 4 and FIG. 5. The volume fraction of nanoscale $L1_2$ precipitates was ~0.25 with a number density of $1.5\times10^{23}$ #/m$^3$ and the mean radius in this alloy was from 7.2-7.24 nm.

TABLE 2

| Sample (Run#) | Total ppts. volume (nm$^3$) | Total # of ppts. | Analyzed Volume (nm$^3$) | Volume Fraction | Mean radius (nm) | # density (#/m$^3$) |
|---|---|---|---|---|---|---|
| FCNATT-2A (16025) | 8.03E+04 | 51 | 3.19E+05 | 25.2% | 7.2 | 1.58E+23 |
| FCNATT-2A (16115) | 3.22E+05 | 206 | 1.36E+06 | 23.6% | 7.2 | 1.51E+23 |

The Fe—Ni based alloy FCNATT-2A has $L1_2$-type g'-$Ni_3M$ precipitates that have a composition of (Ni+Fe+Cr) @ 75 at % and (Al+Ti+Ta) @ 25 at % and the matrix has a composition of (Fe+Cr+Ni) ‡ 95 at % and (Al+Ti+Ta) £5 at. %.

Atom probe measurements on compositions of the precipitates and matrix in the FCNATT-2A alloy annealed at 700° C. show 69.51Ni-4.45Fe-0.28Cr-15.00Al-6.31Ti-4.18Ta, in at % in a Fe-rich matrix with a composition of 58.71Fe-19.08Cr-19.48Ni-2.32Al-0.15Ti-0.1Ta, in at %. FIG. 4 is a plot of at % Ta vs. distance (nm) from the precipitate/matrix interface. FIG. 5 is a plot of at % vs distance (nm) from the precipitate/matrix interface for Al, Fe, Ni, Ti, and Cr.

Figure 6:
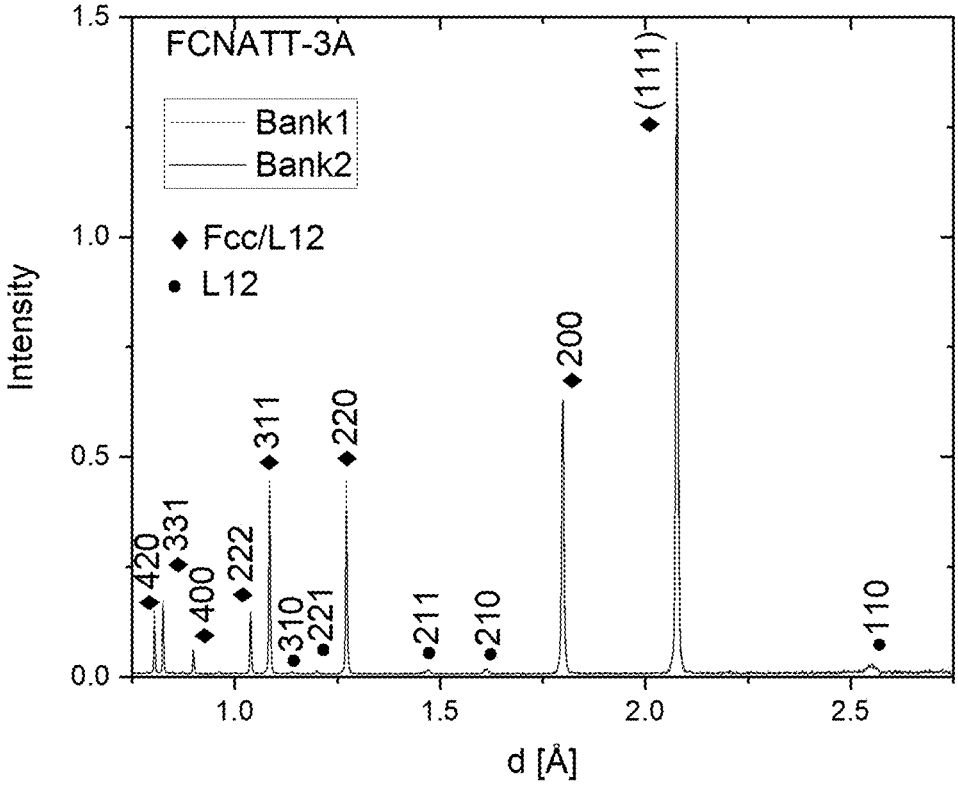
FIG. 6 is a plot of diffraction Intensity of phases vs. lattice spacing d [Å] of phases for FCNATT-3A.
Figure 7:
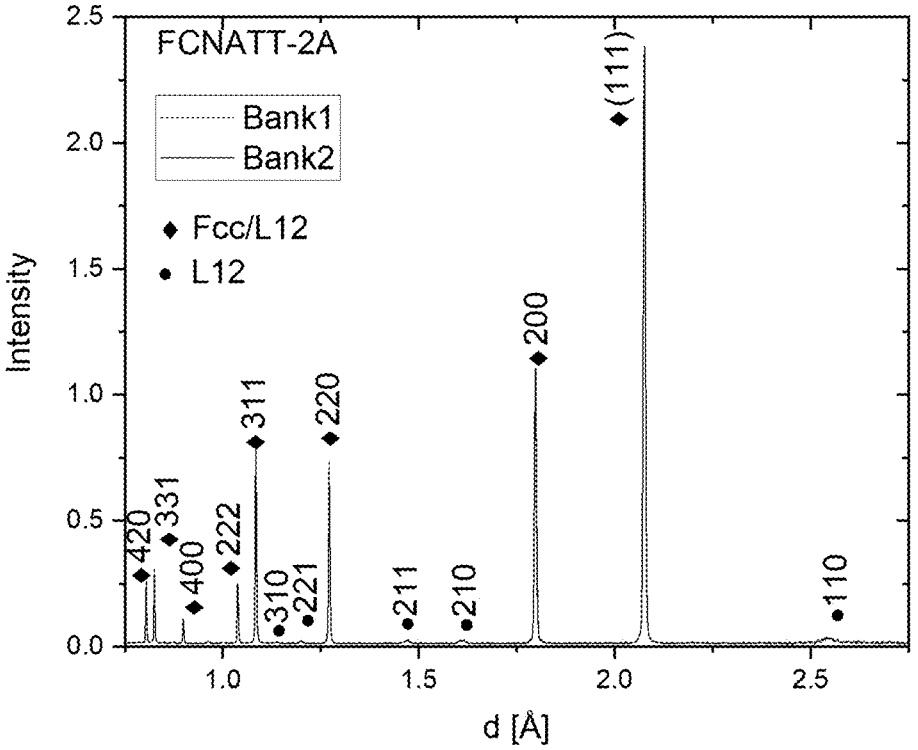
FIG. 7 is a plot of diffraction Intensity of phases vs. lattice spacing d [Å] of phases for FCNATT-2A.

The alloy matrix is free of precipitates other than $L1_2$-type g'-$Ni_3M$ precipitates and have a combined volume fraction of other precipitate phases that is less than 3%, determined by the detection limit of neutron scattering technique. Neutron diffraction spectra obtained from the FCNATT alloy annealed at 700 C for FCNATT-2A are shown in FIG. 6 and at 800 C for FCNATT-3A are shown in FIG. 7. FIG. 6 is a plot of diffraction Intensity of phases vs. lattice spacing d [Å] of phases for FCNATT-3A. FIG. 7 is a plot of diffraction Intensity of phases vs. lattice spacing d [Å] for FCNATT-2A. Neutron diffraction spectra obtained from two orthogonal detector banks that measure the diffraction of grain groups along the rolling direction (RD) and the normal direction (ND) for the FCNATT alloy. The two spectra in each figure were obtained from two different detector banks that measure the diffraction along the rolling direction (RD) and the normal direction (ND). As can be seen, the diffracted intensities of the indexed peaks are similar for these two orthogonal directions indicating that the sample is weakly textured after hot-rolling and annealing. Only peaks from the $L1_2$ precipitate phase and the FCC matrix phase were observed in the neutron diffraction pattern. In general, the detection limit of neutron diffraction is typically less than 1-3%. However, it also depends on the material system. With a strong material scattering structure factor, this value can be smaller than that. The large atomic weight and relatively large size of the precipitates give a stronger scattering effect. After a long collection time for neutron diffraction data, we didn't detect any precipitates with size larger than 10 nm.

The Fe—Ni based alloy has a lattice mismatch of the $L1_2$-type g'-$Ni_3M$ precipitates and the fcc matrix that is less than 0.05%. The lattice mismatch can be 0, 0.001, 0.005, 0.01, 0.015, 0.02, 0.025, 0.03, 0.035, 0.04, 0.045, and 0.05%, or can be within a range of any high value and low value selected from these values. The high-resolution neutron diffraction spectra in FIG. 6 and FIG. 7 were used for Rietveld refinement that was performed using GSAS with EXPGUI. The fcc and $L1_2$ structures were used to refine the phase fraction, lattice misfit, etc. The resulted lattice parameters for $L1_2$ and fcc, a($L1_2$) or a(fcc), are listed in Table 3 below. The lattice misfit was then calculated through the formula of (a($L1_2$)-A(fcc))/a($L1_2$). The calculated misfit between $L1_2$ precipitates and the fcc Fe—Ni—Cr matrix is ~0.03%, while that for most Ni-based super alloys is greater than 0.1%. [Caron, P. (2000). "High y' solvus new generation nickel-based superalloys for single crystal turbine blade applications," *Superalloys,* 2000, 737-746 incorporated herein by reference.]

TABLE 3

Rietveld refinement results showing the small lattice misfit between matrix and precipitates.

| Sample | f(γ) | f(L12) | a(γ) | a(L12) | Misfit |
|---|---|---|---|---|---|
| FCNATT-3A | 81.0 | 19.0 | 3.59596 | 3.59719 | 0.034% |
| FCNATT-2A | 77.8 | 22.2 | 3.59860 | 3.59971 | 0.031% |

Figure 8:
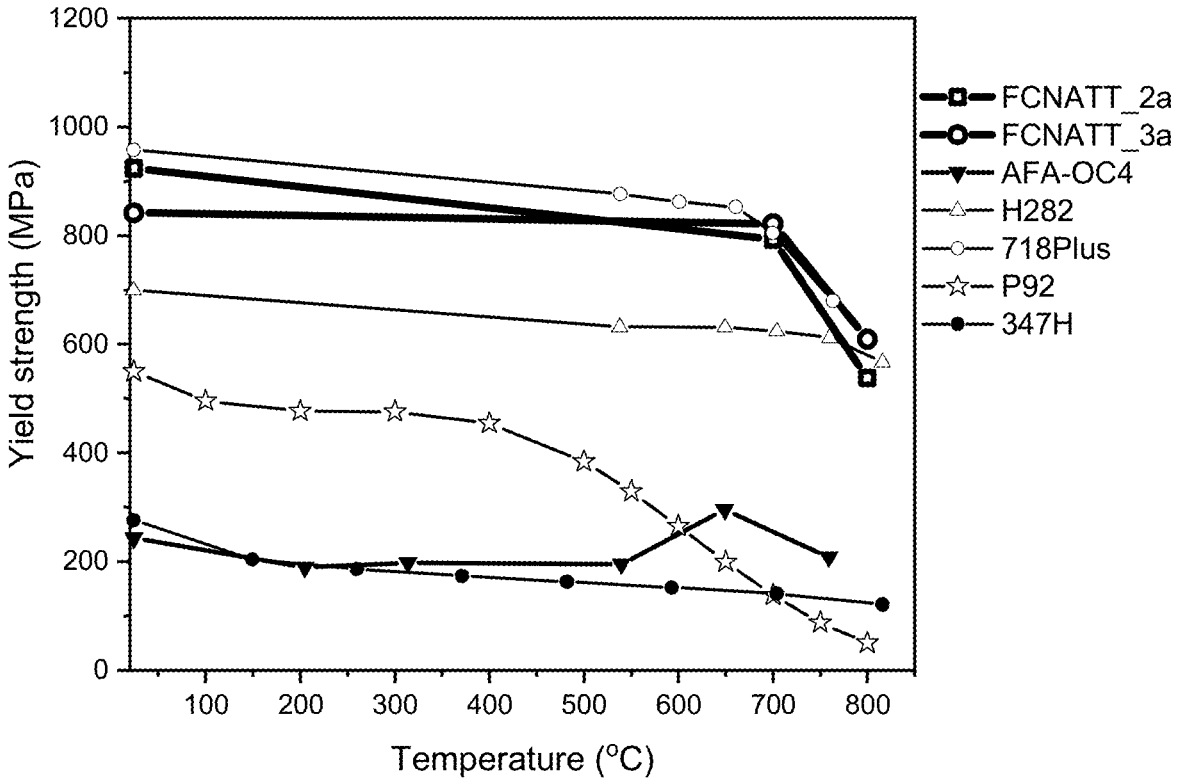
FIG. 8 is a plot of yield strength (MPa) vs. temperature (° C.) for FCNATT-2A annealed at 700° C. and FCNATT-3A annealed at 800° C., compared with commercial heat-resistant alloys including Ni-based alloys 718plus and H282, and Fe-based alloys AFA-OC4, 347H and P92.

The Fe—Ni based alloys have high temperature yield strength greater than or equal to 800 MPa at 700 C and greater than 500 MPa at 800 C. The tensile properties of FCNATT annealed at 700° C. for FCNATT-2A and 800° C. for FCNATT-3A are plotted in FIG. 8, and compared with commercial heat-resistant alloys including Ni-based alloys 718plus and H282, and Fe-based alloys AFA-OC4, 347H and P92. Tensile properties of FCNATT as a function of temperature, compared with AFA-OC4, 347H, 718plus, H282 and P92. The high temperature strength of Fe—Ni based FCNATT alloy is comparable to Ni-based 718Plus, and greater than the Ni-based H282, and much better than Fe-based AFA-OC4, 347H and P92 alloys.

Figure 9:
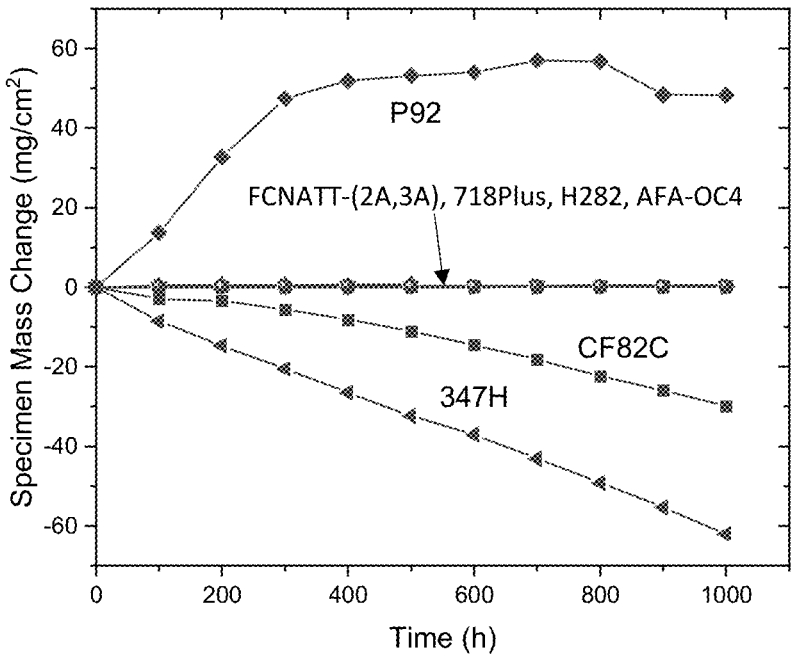
FIG. 9 is a plot of specimen mass change ($mg/cm^2$) in full scale of −60 to 60 vs. time (h).
Figure 10:
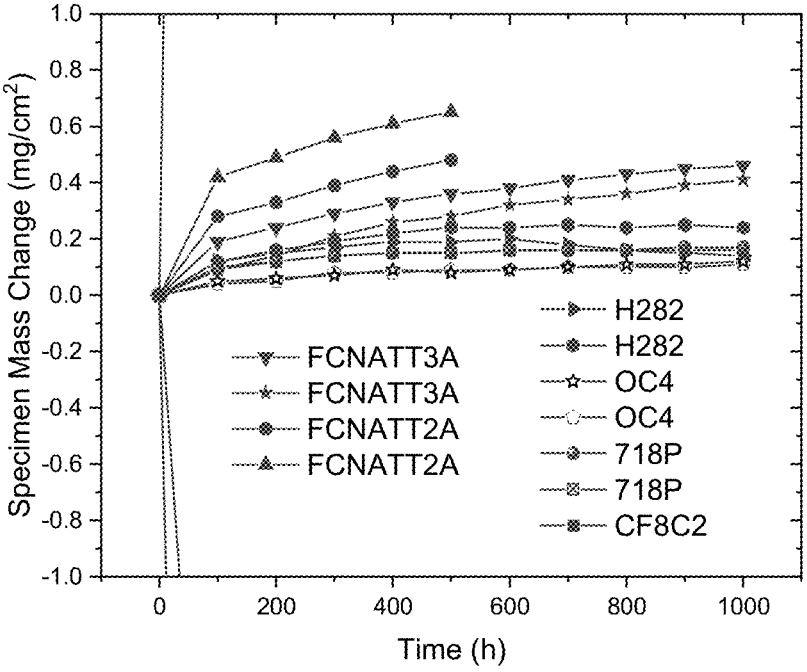
FIG. 10 is a plot of specimen mass change ($mg/cm^2$) in enlarged scale of −1.0 to 1.0 vs. time (h).
Figure 11:
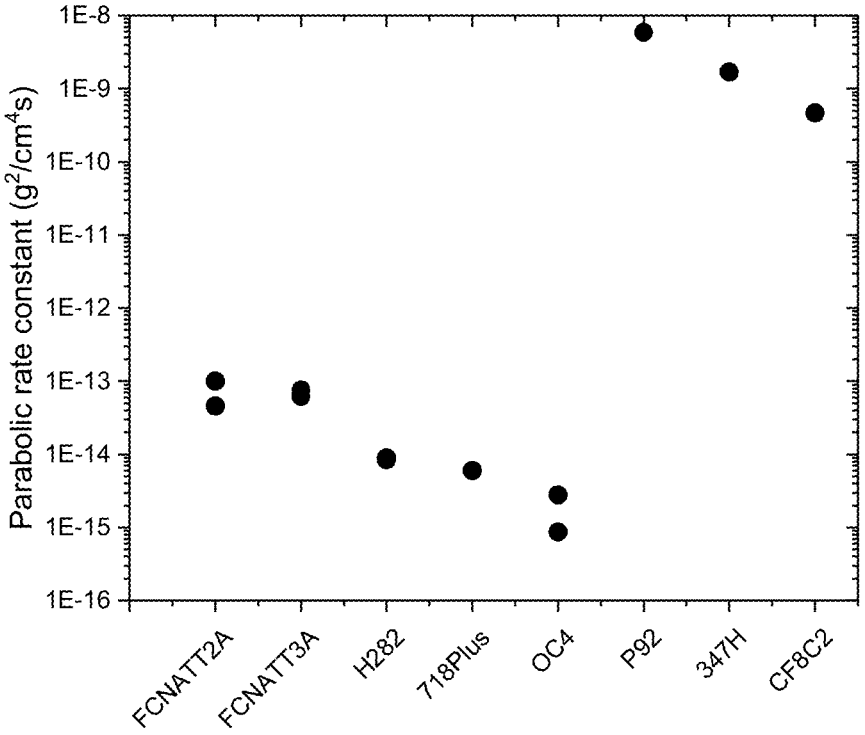
FIG. 11 is a plot of parabolic rate constant ($g^2/cm^4s$) for the FCNATT-2A and FCNATT-3A alloys of the invention, and prior Ni-based alloys 718plus and H282, and Fe-based alloys AFA-OC4, 347H, CF8C2 and P92.

The Fe—Ni based alloys of the invention have acceptable oxidation resistance that is comparable to more expensive alloys. The oxidation rate constant at 800° C. in air+10% water vapor is in the order of from $1\times10^{-13}$ to $1\times10^{-14}$ ($g^2/cm^4\cdot s$). The weight changes of the FCNATT alloys oxidized at 800° C. in air+10% water vapor are plotted in FIG. 9 with the y-axis in full scale (−60 to 60), and in FIG. 10 at an enlarged scale (−1 to 1). FIG. 9 and FIG. 10 show that the invention alloys provide comparable oxidation resistance when compared to Ni-based alloys 718plus and H282, but much better oxidation resistance than Fe-based alloys of 347H, CF8C2 and P92 alloys. The oxidation rate constants calculated from the weight changes are plotted in FIG. 11 for different alloys. The Fe—Ni alloys of the invention exhibit oxidation behavior more like the Ni-based alloys H282 and 718 plus than other Fe-based alloys such as 347H, CF8C2 and P92.

The Fe—Ni alloys of the invention have similar strength and oxidation resistance as 718plus. But the cost for materials and fabrication of the current alloys is less than that for 718plus. The table below lists the composition of FCNATT and 718plus and examples of relative price of constituent elements in usd/ton, subject to commodity price changes. The total material cost for FCNATT is $11624 USD/Ton, comparing favorably to that of 718plus, $14731 USD/Ton, representing a 27% cost reduction. The high-throughput alloy design also enables less complicated heat-treatment schemes for the current FCNATT alloys than the 718plus, which also means less cost, as indicated in Table 4 below:

TABLE 4

Component cost comparison

| | Fe | Ni | Cr | Mo | Co | W | Nb | Al | Ti | Ta | Alloy price, USD/ton |
|---|---|---|---|---|---|---|---|---|---|---|---|
| 718plus composition, wt % | 9.5 | 52.1 | 18 | 2.7 | 9.1 | 1 | 5.4 | 1.45 | 0.75 | 0 | 14731.02 |
| FCNATT composition, wt % | 43.7 | 35 | 13 | 0 | 0 | 0 | 0 | 3 | 1.5 | 3.8 | 11624.65 |
| Element price, USD/ton | 95.22 | 13507 | 7400 | 26000 | 33000 | 30300 | 42280 | 1773 | 4800 | 151800 | |

FCNATT-2A: 700° C.-47 h-water quench
FCNATT-3A: 800° C.-4 h-water quench
718p1us: 954° C.-982° C.-1 Hr-Rapid Cool + 788° C.-2-8 Hrs-FC @ 56° C./min. + 649° C.-704° C.-8 Hrs-AC The Fe—Ni based alloys were annealed at 700° C. for 47 h or 800° C. for 4 h. Before annealing, the Fe—Ni based alloys of the invention were homogenized at 1100 C for 2 h, then hot-rolled to a sheet with a 75% thickness reduction at 1100 C, and then re-homogenized at 1100 C for 30 min followed by a cold water quench. The annealing steps are made easier by the alloy design which allows the presence of only the $L1_2$ precipitates. The Fe—Ni based alloys of the invention are best heat-treated at temperatures of between 700-800° C. Other heat treatments are possible.

The Ta addition of alloys of the invention stabilizes the $L1_2$-type g'-Ni3M structure and reduces the misfit between these precipitates and the face-centered cubic matrix. When annealed in the temperature range of 700-800° C., these alloys resulted in microstructures with up to 30 volume percent of the $L1_2$-type g'-Ni3M precipitates that are homogeneously distributed in the fcc matrix. The superior high temperature strength is primarily contributed by the ultrafine $L1_2$-type g'-Ni3M precipitates. The oxidation resistance at high temperature (>700° C.) is provided by the combination of Cr and Al contents.

The invention as shown in the drawings and described in detail herein disclose arrangements of elements of particular construction and configuration for illustrating preferred embodiments of structure and method of operation of the present invention. It is to be understood however, that elements of different construction and configuration and other arrangements thereof, other than those illustrated and described may be employed in accordance with the spirit of the invention, and such changes, alterations and modifications as would occur to those skilled in the art are considered to be within the scope of this invention as broadly defined in the appended claims. In addition, it is to be understood that the phraseology and terminology employed herein are for the purpose of description and should not be regarded as limiting.

We claim:

1. A Fe—Ni based alloy comprising, in weight percent;

Ni 30-35
Cr 12-14
Al 3-5
Ti 0-2
Ta 2-8
C<=0.05
B<=0.005
Zr<=0.2
Si<0.5
Cr/(Cr+Fe+Ni)=0.125-0.145
Al/(Al+Ti+Ta)=0.15-0.5
Fe≥Ni
Fe/Ni=1.0-2.0 balance Fe, the alloy having a face-centered cubic (fcc) matrix with from 25 to 30 vol. % of $L1_2$-type $\gamma'$-$Ni_3M$ (M=Al, Ta, Ti and mixtures thereof) precipitates, wherein a majority volume fraction of the precipitates are $L1_2$-type $\gamma'$-$Ni_3M$ precipitates and the combined volume fraction of other precipitate phases is less than 3%, based on the total volume of the alloy.

2. The Fe—Ni based alloy of claim 1, wherein the $L1_2$-type γ'-Ni3M precipitates have a mean radius of from 5 to 10 nm and number density in the order of $1\times10^{23}$ to $1\times10^{24}$ #/$m^3$.

3. The Fe—Ni based alloy of claim 1, wherein the $L1_2$-type γ'-$Ni_3M$ precipitates have a composition of (Ni+Fe+Cr)≅75 at % and (Al+Ti+Ta)≅25 at % and the matrix have a composition of (Fe+Cr+Ni)≥95 at % and (Al+Ti+Ta)≤5 at %.

4. The Fe—Ni based alloy of claim 1, wherein the alloy is free of precipitates other than $L1_2$-type γ'-$Ni_3M$ precipitates.

5. The Fe—Ni based alloy of claim 1, wherein lattice mismatch of the $L1_2$-type γ'-$Ni_3M$ precipitates and the fcc matrix is less than 0.05%.

6. The Fe—Ni based alloy of claim 1, wherein the alloy has high temperature yield strength greater than or equal to 800 MPa at 700° C. and greater than 500 MPa at 800° C.

7. The Fe—Ni based alloy of claim 1, wherein the oxidation rate constant at 800° C. in air+10% water vapor is in the order of from $1\times10^{-13}$ to $1\times10^{-14}$ ($g^2/cm^4\cdot s$).

* * * * *